US009790819B2

(12) United States Patent
Lee et al.

(10) Patent No.: US 9,790,819 B2
(45) Date of Patent: Oct. 17, 2017

(54) VARIABLE VALVE LIFT SYSTEM

(71) Applicant: HYUNDAI MOTOR COMPANY, Seoul (KR)

(72) Inventors: JangSu Lee, Yongin-si (KR); Hyo Sang Cho, Suwon-si (KR); Hyoung Hyoun Kim, Hwaseong-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 91 days.

(21) Appl. No.: 14/864,841

(22) Filed: Sep. 24, 2015

(65) Prior Publication Data

US 2016/0138437 A1 May 19, 2016

(30) Foreign Application Priority Data

Nov. 14, 2014 (KR) ..... 10-2014-0158772

(51) Int. Cl.
*F01L 1/14* (2006.01)
*F01L 1/24* (2006.01)
*F01L 1/047* (2006.01)

(52) U.S. Cl.
CPC ..... *F01L 1/24* (2013.01); *F01L 1/047* (2013.01)

(58) Field of Classification Search
CPC ..... F01L 1/24; F01L 1/047
See application file for complete search history.

(56) References Cited

U.S. PATENT DOCUMENTS

| | | | | |
|---|---|---|---|---|
| 7,207,300 | B2 | 4/2007 | Ezaki et al. | |
| 2008/0110425 | A1* | 5/2008 | Endoh | F01L 1/047 123/90.16 |
| 2011/0061615 | A1* | 3/2011 | Hendriksma | F01L 1/24 123/90.15 |

FOREIGN PATENT DOCUMENTS

| | | | |
|---|---|---|---|
| JP | H05-71322 | A | 3/1993 |
| JP | 2007-138787 | A | 6/2007 |
| JP | 4292147 | B2 | 7/2009 |
| KR | 101154412 | B1 | 6/2012 |

* cited by examiner

*Primary Examiner* — Zelalem Eshete
(74) *Attorney, Agent, or Firm* — McDermott Will & Emery LLP

(57) ABSTRACT

A variable valve lift system may include a roller finger follower having an end connected with a valve and a roller mounted thereto. A hydraulic lash adjuster supports another end of the roller finger follower and has operating modes which are changed to a high lift mode or a low lift mode according to supplied hydraulic pressure to change a height of the hydraulic lash adjuster. A hydraulic pressure supplying portion supplies the hydraulic pressure to the hydraulic lash adjuster. A cam is mounted to a camshaft and contacts the roller of the roller finger follower. The cam has a first ramp and a second ramp formed thereon.

16 Claims, 5 Drawing Sheets

VARIABLE VALVE LIFT SYSTEM

CROSS-REFERENCE TO RELATED APPLICATION

This application claims the benefit of priority to Korean Patent Application No. 10-2014-0158772 filed in the Korean Intellectual Property Office on Nov. 14, 2014, the entire content of which is incorporated herein by reference.

TECHNICAL FIELD

The present disclosure relates to a variable valve lift system. More particularly, the present disclosure relates to a variable valve lift system capable of performing two valve lifts using a hydraulic lash adjuster.

BACKGROUND

An internal combustion engine generates power by burning fuel in a combustion chamber in an air media drawn into the chamber. Intake valves are operated by a camshaft in order to intake the air, and the air is drawn into the combustion chamber while the intake valves are open. In addition, exhaust valves are operated by the camshaft, and a combustion gas is exhausted from the combustion chamber while the exhaust valves are open.

The optimal operation of the intake valves and the exhaust valves depends on a rotational speed of the engine. That is, an optimal lift or optimal opening/closing timing of the valves depends on the rotational speed of the engine. In order to achieve such optimal valve operation depending on the rotational speed of the engine, various researches, such as designing of a plurality of cams and a variable valve lift (VVL) that can change valve lift according to engine speed, have been undertaken.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide a variable valve lift system which can perform two valve lifts using a hydraulic lash adjuster.

A variable valve lift system according to an exemplary embodiment of the present inventive concept may include a roller finger follower having an end connected to a valve and a roller mounted thereto. A hydraulic lash adjuster supports another end of the roller finger follower and has operating modes changing to a high lift mode or a low lift mode according to supplied hydraulic pressure to change a height of the hydraulic lash adjuster. A hydraulic pressure supplying portion supplies the hydraulic pressure to the hydraulic lash adjuster. A cam is mounted to a camshaft and contacts the roller of the roller finger follower. The cam has a first ramp and a second ramp formed thereon.

The cam may include a base circle with a first radius and a virtual base circle with a second radius which is larger than the first radius. The first ramp may be formed based on the base circle, and the second ramp may be formed based on the virtual base circle.

A radius difference between the base circle and the virtual base circle may be determined according to a height difference between a height of the hydraulic lash adjuster in the high lift mode and a height of the hydraulic lash adjuster in the low lift mode, mounting positions of the roller finger follower, the cam, and the hydraulic lash adjuster, and mounting gaps of the roller finger follower, the cam, and the hydraulic lash adjuster.

The hydraulic lash adjuster may include an adjust housing mounted to a cylinder head. An adjust unit adjusts a clearance of the valve and a connecting portion selectively connecting the adjust unit and the adjust housing.

The adjust unit may include an inner plunger supporting the other end of the roller finger follower. The inner plunger has inner oil supply holes and an inner oil exhaust hole formed therein. The inner plunger is slidable vertically within an outer plunger. Outer oil supply holes which communicate with the inner oil supply holes are formed in the outer plunger. A hydraulic pressure chamber communicates with an inner side of the inner plunger through the inner oil exhaust hole. A check ball is disposed within the hydraulic pressure chamber for selectively closing the inner oil exhaust hole, and a check ball elastic portion biases the check ball. Adjust housing holes of the adjust housing communicate with the outer oil supply holes.

The connecting portion may include a lock pin slidable laterally within the outer plunger and an elastic portion biasing the lock pin. A lock pin hole may be formed in the adjust housing, and the lock pin may slide outwards to be inserted into the lock pin hole when hydraulic pressure is supplied to the lock pin from the hydraulic pressure supplying portion.

The variable valve lift system may further include a lost motion spring disposed within the adjust housing for biasing the outer plunger.

The variable valve lift system may further include a stopper disposed within the adjust housing for limiting movement of the outer plunger.

A variable valve lift system according to another exemplary embodiment of the present inventive concept may include a cam mounted to a camshaft and having a first ramp and a second ramp formed thereon. A roller finger follower has one end connected to a valve. A roller which contacts the cam is mounted to the roller finger follower. A hydraulic lash adjuster supports another end of the roller finger follower and comprises an adjust housing which is mounted to a cylinder head. An adjust unit adjusts a clearance of the valve and a connecting portion selectively connecting the adjust unit and the adjust housing for changing a height of the hydraulic lash adjuster. A hydraulic pressure supplying portion supplies hydraulic pressure to the hydraulic lash adjuster.

The cam may include a base circle with a first radius and a virtual base circle with a second radius which is larger than the first radius. The first ramp may be formed based on the base circle, and the second ramp may be formed based on the virtual base circle.

A radius difference between the first base circle and the second base circle may be determined according to a height difference between a height of the hydraulic lash adjuster in a high lift mode and a height of the hydraulic lash adjuster in a low lift mode, mounting positions of the roller finger follower, the cam, and the hydraulic lash adjuster, and mounting gaps of the roller finger follower, the cam, and the hydraulic lash adjuster.

The adjust unit may include an inner plunger supporting the other end of the roller finger follower, and the inner plunger of which inner oil supply holes and an inner oil exhaust hole are formed therein. The inner plunger is slidable vertically within an outer plunger. Outer oil supply holes communicate with the inner oil supply holes. A hydraulic pressure chamber communicates with an inner side of the inner plunger through the inner oil exhaust hole. A check ball is disposed within the hydraulic pressure chamber for selectively closing the inner oil exhaust hole and a check ball elastic portion biases the check ball. Adjust housing holes of the adjust housing communicate with the outer oil supply holes.

The connecting portion may include a lock pin slidable laterally within the outer plunger and an elastic portion biasing the lock pin. A lock pin hole may be formed in the adjust housing, and the lock pin may slide outwards to be inserted into the lock pin hole when hydraulic pressure is supplied to the lock pin from the hydraulic pressure supplying portion.

The variable valve lift system may further include a lost motion spring disposed within the adjust housing for biasing the outer plunger.

The variable valve lift system may further include a stopper disposed within the adjust housing for limiting movement of the outer plunger.

The variable valve lift system according to the exemplary embodiments of the present inventive concept may perform two valve lifts using a hydraulic lash adjuster.

The variable valve lift system according to the exemplary embodiments of the present inventive concept may improve dynamic characteristic of a valve by applying ramp to a cam.

DETAILED DESCRIPTION OF THE EMBODIMENTS

Figure 1:
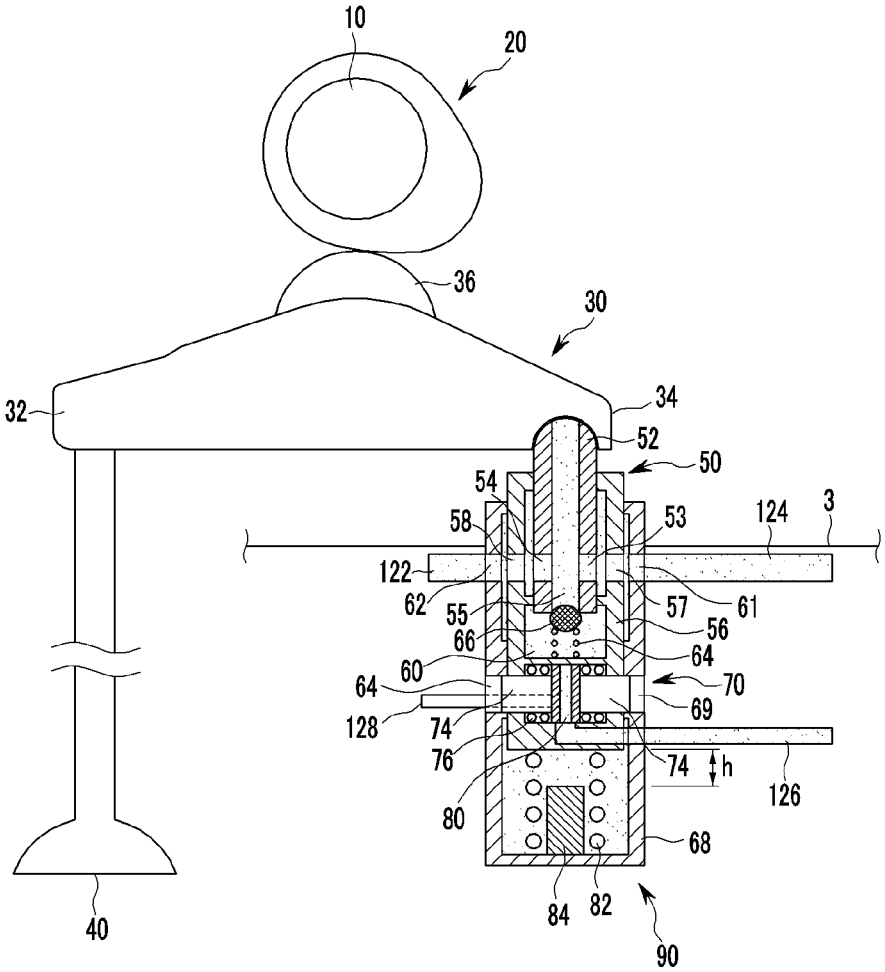
FIG. 1 and FIG. 2 are drawings showing a variable valve lift system according to an exemplary embodiment of the present inventive concept.

In the following detailed description, only certain exemplary embodiments of the present inventive concept have been shown and described, simply by way of illustration.

As those skilled in the art would realize, the described embodiments may be modified in various different ways, all without departing from the spirit or scope of the present disclosure.

Throughout the specification, like numbers refer to like elements.

In the drawings, the thickness of layers, films, panels, regions, etc., are exaggerated for clarity.

It will be understood that when an element such as a layer, film, region, or substrate is referred to as being "on" another element, it can be directly on the other element or intervening elements may also be present.

In contrast, when an element is referred to as being "directly on" another element, there are no intervening elements present.

Throughout the specification, unless explicitly described to the contrary, the word "comprise" and variations such as "comprises" or "comprising" will be understood to imply the inclusion of stated elements but not the exclusion of any other elements.

An exemplary embodiment of the present inventive concept will hereinafter be described in detail with reference to the accompanying drawings.

Figure 2:
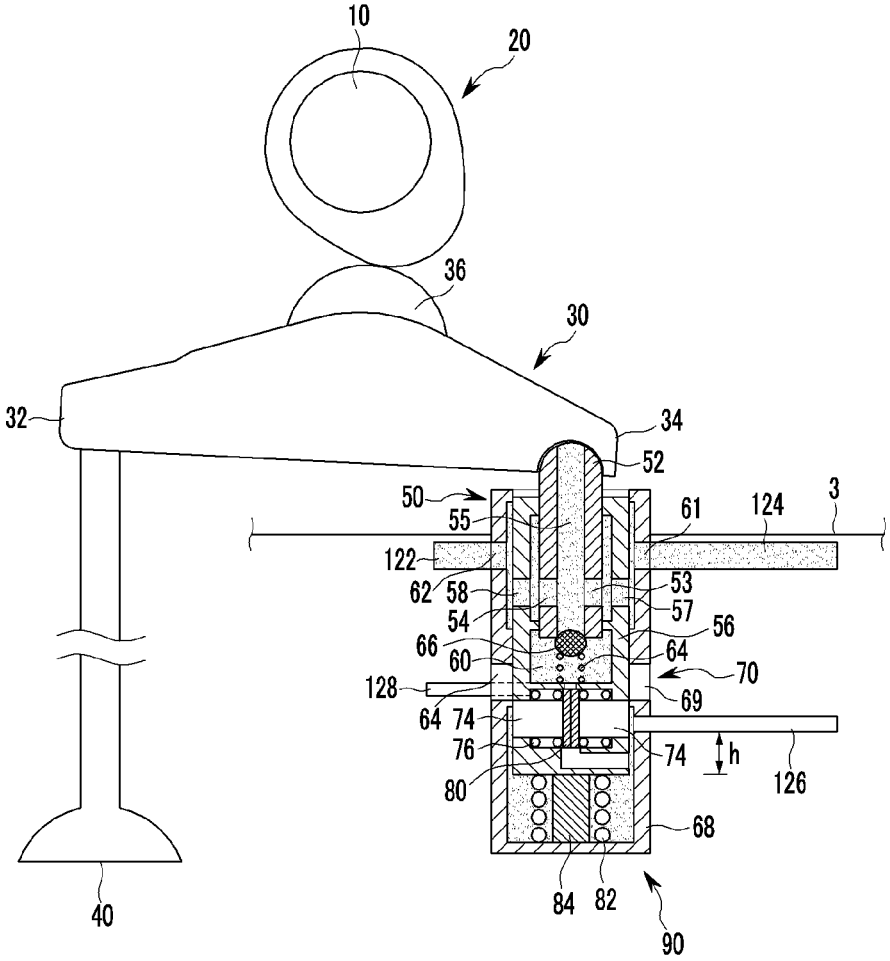

FIGS. 1 and 2 show a variable valve lift system according to an exemplary embodiment of the present inventive concept.

Referring to FIGS. 1 and 2, a variable valve lift system according to an exemplary embodiment of the present inventive concept includes a roller finger follower 30 of which a valve 40 is connected to an end 32 thereof, and a roller 36 is mounted thereto. A hydraulic lash adjuster 90 supports another end 34 of the roller finger follower 30 and operating modes thereof are changed to a high lift mode or a low lift mode according to supplied hydraulic pressure so as to change a height of the hydraulic lash adjuster 90. A hydraulic pressure supplying portion (not shown) supplies the hydraulic pressure to the hydraulic lash adjuster 90. A camshaft 10 and a cam 20 are mounted to the camshaft 10 and contact the roller 36 of the roller finger follower 30.

The hydraulic lash adjuster 90 includes an adjust housing 68 mounted to a cylinder head 3. An adjust unit 50 adjusts a clearance of the valve 40, and a connecting portion 70 selectively connects the adjust unit 50 and the adjust housing 68.

The adjust unit 50 includes an inner plunger 52 supporting the other end 34 of the roller finger follower 30. The inner plunger 52 has inner oil supply holes 53, and 54 and an inner oil exhaust hole 55. An outer plunger 56 has the inner plunger 52 slidable therewithin. Outer oil supply holes 57 and 58 communicate with the inner oil supply holes 53 and 54. A hydraulic pressure chamber 60 communicates with an inner side of the inner plunger 52 through the inner oil exhaust hole 55. A check ball 66 is disposed within the hydraulic pressure chamber 60 for selectively closing the inner oil exhaust hole 55. A check ball elastic portion 64 biases the check ball 66.

Adjust housing holes 61 and 62 communicate with the outer oil supply holes 57 and 58 in the adjust housing 68.

The connecting portion 70 includes a lock pin 74 slidable within the outer plunger 56 and an elastic portion 76 biasing the lock pin 74. A lock pin hole 69 is formed on the adjust housing 68, and the lock pin 74 protrudes to be inserted into the lock pin hole 69 when the hydraulic pressure is supplied to the lock pin 74 from the hydraulic pressure supplying portion.

A connecting chamber 80 is formed in the outer plunger 56 for supplying hydraulic pressure to the lock pin 74. When the hydraulic pressure is supplied to the connecting chamber 80 from the hydraulic pressure supplying portion, the lock pin 74 is inserted into the lock pin hole 69.

A lost motion spring 82 for biasing the outer plunger 56 and a stopper 84 for limiting movement of the outer plunger 56 are disposed within the adjust housing 68.

The hydraulic pressure supplying portion includes adjusting lines 122 and 124 adjusting the hydraulic pressure within the inner plunger 52, a control line 126 supplying the hydraulic pressure to the connecting portion 70, and a drain line 128 exhausts the hydraulic pressure within the connecting portion 70.

The hydraulic pressure supplied to the connecting chamber 80 is drained though the drain line 128.

Figure 4:
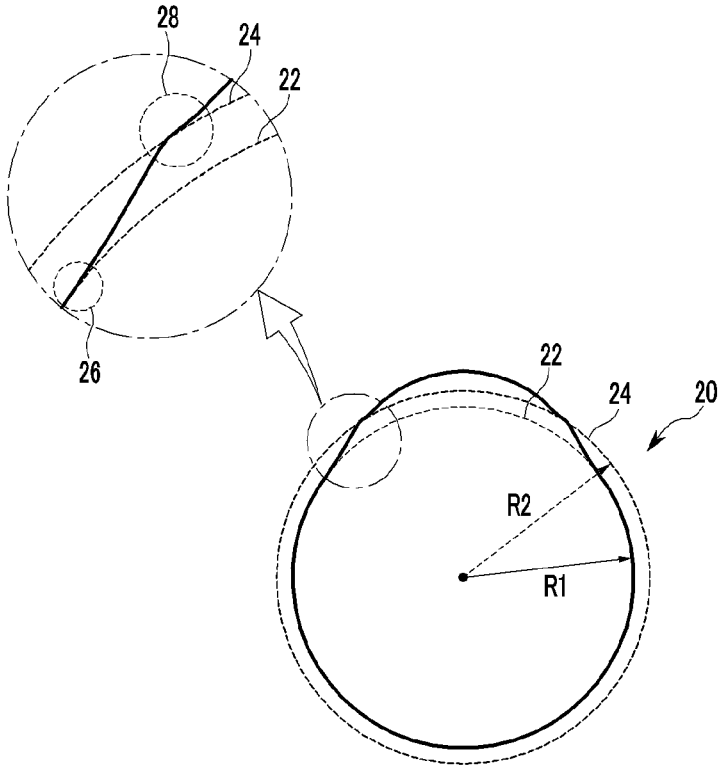
FIG. 4 is a drawing showing a cam applied to a variable valve lift system according to an exemplary embodiment of the present inventive concept.

FIG. 4 shows a cam applied to a variable valve lift system according to an exemplary embodiment of the present invention.

Referring to FIG. 4, a first ramp 26 and a second ramp 28 are formed on the cam 20.

The cam 20 includes a base circle 22 with a first radius R1 and a virtual base circle 24 with a second radius R2 larger than the first radius R1. The first ramp 26 is formed based on the base circle 22, and the second ramp 28 is formed based on the virtual base circle 24.

A radius difference between the base circle 22 and the virtual base circle 24 is determined according to a height difference between a height of the hydraulic lash adjuster 90 in the high lift mode and a height of the hydraulic lash adjuster 90 in the low lift mode, mounting positions of the roller finger follower 30, the cam 20 and the hydraulic lash adjuster 90, and mounting gaps of the roller finger follower 30, the cam 20, and the hydraulic lash adjuster 90.

Figure 3A:
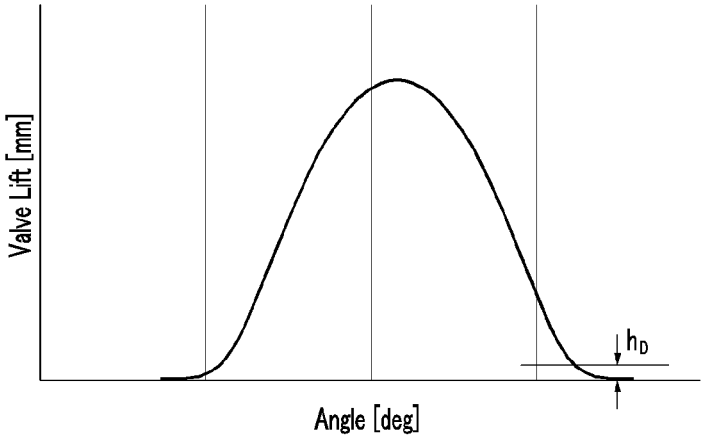
FIG. 3A (Related Art)
FIGS. 3A and 3B are graphs showing a valve lift profile of a variable valve lift system according to a related art and an exemplary embodiment of the present inventive concept, respectively.
Figure 3B:
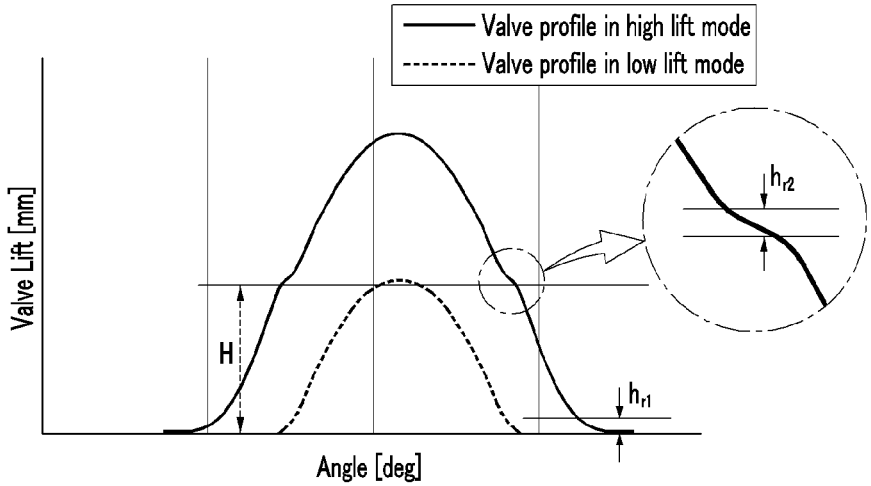

FIGS. 3A and 3B are graphs showing a valve lift profile of a variable valve lift system according to a related art and an exemplary embodiment of the present inventive concept, respectively.

As shown in FIG. 3A, a valve lift apparatus with a general cam realizes profiles with one ramp $h_0$ and the ramp $h_0$ may suppress rapid speed change during closing and opening of a valve. That is, deterioration of dynamic characteristic of a valve may be prevented. However, dynamic characteristic of a valve may be deteriorated in a low lift mode.

The cam 20 applied to the variable valve lift system according to the present disclosure has the first ramp 26 and the second ramp 28 as shown in FIG. 4 and FIG. 3B. The first ramp 26 may suppress deterioration of dynamic characteristic of the valve 40 in a high lift mode and the second ramp 28 may suppress deterioration of dynamic characteristic of the valve 40 in a low lift mode.

A lift difference H between the high lift mode and the low lift mode is determined according to a distance of lost motion h in FIGS. 1 and 2, that is, a distance between the outer plunger 56 and the stopper 84, a mounting position of the roller finger follower 30 and so on.

Sizes of the first ramp 26 and the second ramp 28, as shown as hr1 and hr2, are determined according to the dynamic characteristic of the valve. The size hr2 of the second ramp 28 may be smaller than the size hr1 of the first ramp 26 since the hr2 is applied to the low lift mode.

Hereinafter, operations of the variable valve lift system according to the present disclosure will be described.

When hydraulic pressure is supplied to the adjusting lines 122 and 124, oil is supplied and stored in the hydraulic pressure chamber 60 through the outer oil supply holes 57 and 58 and the inner oil supply holes 53 and 54, and the inner oil exhaust hole 55 is blocked by the check ball 66 after the oil in the hydraulic pressure chamber 60 is sufficiently supplied.

If a clearance of the valve 40 is generated by abrasion or the like, the hydraulic pressure is supplied to the hydraulic pressure chamber 60 so as to adjust a height of the inner plunger 52 and then the check ball 66 blocks the inner oil exhaust hole 55.

As shown in FIG. 1, in the high lift mode, oil is supplied to the control line 126, and then the lock pin 74 is inserted into the lock pin hole 69. Then, the adjust unit 50 and the adjust housing 68 are connected to realize a valve profile of the high lift mode in FIG. 3B.

In this case, deterioration of dynamic characteristic of the valve 40 may be suppressed by the first ramp 26.

As shown in FIG. 2, in the low lift mode, oil is not supplied to the control line 126 but drained through the drain line 128. Then, the lock pin 74 is separated from the lock pin hole 69 by the elastic portion 76, and the adjust unit 50 and the adjust housing 68 are separated from each other.

Then, a valve profile of the low lift mode as shown in FIG. 3B may be realized.

The variable valve lift system according to the exemplary embodiment of the present inventive concept may perform two valve lifts using a hydraulic lash adjuster, and may improve dynamic characteristic of a valve by applying ramp to a cam.

While this invention has been described in connection with what is presently considered to be practical exemplary embodiments, it is to be understood that the invention is not limited to the disclosed embodiments. On the contrary, it is intended to cover various modifications and equivalent arrangements included within the spirit and scope of the appended claims.

What is claimed is:

1. A variable valve lift system comprising:

a roller finger follower having an end connected with a valve and a roller mounted thereto;

a hydraulic lash adjuster supporting another end of the roller finger follower and of which operating modes are changed to a high lift mode or a low lift mode according to a supplied hydraulic pressure to change a height of the hydraulic lash adjuster;

a hydraulic pressure supplying portion supplying the hydraulic pressure to the hydraulic lash adjuster;

a camshaft; and a cam mounted to the camshaft and contacting the roller of the roller finger follower and having a first ramp and a second ramp are formed thereto, wherein the hydraulic lash adjuster comprises:

an adjust housing mounted to a cylinder head;

an adjust unit adjusting a clearance of the valve; and a connecting portion selectively connecting the adjust unit and the adjust housing, and wherein the hydraulic pressure supplying portion includes a drain line communicating with the connection portion and exhausting the hydraulic pressure.

2. The variable valve lift system of claim 1, wherein the cam comprises a base circle with a first radius and a virtual base circle with a second radius larger than the first radius, wherein the first ramp is formed based on the base circle, and the second ramp is formed based on the virtual base circle.

3. The variable valve lift system of claim 1, wherein a difference between the first radius and the second radius increases as a difference between a height of the hydraulic lash adjuster in the high lift mode and a height of the hydraulic lash adjuster in the low lift mode increases.

4. The variable valve lift system of claim 1, wherein the adjust unit comprises:

an inner plunger supporting the other end of the roller finger follower and having inner oil supply holes and an inner oil exhaust hole formed therein;

an outer plunger of which the inner plunger is slidable vertically therewithin, outer oil supply holes communicating with the inner oil supply holes are formed therein, and a hydraulic pressure chamber communicating with an inner side of the inner plunger through the inner oil exhaust hole is formed therein;

a check ball disposed within the hydraulic pressure chamber for selectively closing the inner oil exhaust hole; and a check ball elastic portion biasing the check ball, wherein the adjust housing has adjust housing holes communicating with the outer oil supply holes.

5. The variable valve lift system of claim 1, wherein the connecting portion comprises:

a lock pin slidable laterally within the outer plunger; and an elastic portion biasing the lock pin;

wherein the adjust housing has a lock pin hole formed therein, and the lock pin slides outwards to be inserted into the lock pin hole when hydraulic pressure is supplied to the lock pin from the hydraulic pressure supplying portion.

6. The variable valve lift system of claim 1, wherein the variable valve lift system further comprises a lost motion spring disposed within the adjust housing for biasing the outer plunger.

7. The variable valve lift system of claim 1, wherein the variable valve lift system further comprises a stopper disposed within the adjust housing for limiting movement of the outer plunger.

8. The variable valve lift system of claim 4, wherein the hydraulic pressure supplying portion includes:

adjusting lines adjusting the hydraulic pressure within the inner plunger; and a control line supplying the hydraulic pressure to the connecting portion.

9. A variable valve lift system comprising:

a cam mounted to a camshaft and having a first ramp and a second ramp formed on the cam;

a roller finger follower having an end connected with a valve and a roller, which contacts the cam, mounted thereto;

a hydraulic lash adjuster supporting another end of the roller finger follower and comprising: an adjust housing mounted to a cylinder head; an adjust unit adjusting a clearance of the valve; and a connecting portion selectively connecting the adjust unit and the adjust housing for changing a height of the hydraulic lash adjuster; and a hydraulic pressure supplying portion supplying hydraulic pressure to the hydraulic lash adjuster, wherein the hydraulic pressure supplying portion includes a drain line communicating with the connection portion and exhausting the hydraulic pressure.

10. The variable valve lift system of claim 9, wherein the cam comprises a base circle with a first radius and a virtual base circle with a second radius which is larger than the first radius, wherein the first ramp is formed based on the base circle, and the second ramp is formed based on the virtual base circle.

11. The variable valve lift system of claim 10, wherein a difference between the first radius and the second radius increases as a difference between a height of the hydraulic lash adjuster in the high lift mode and a height of the hydraulic lash adjuster in the low lift mode increases.

12. The variable valve lift system of claim 9, wherein the adjust unit comprises:

an inner plunger supporting the other end of the roller finger follower and having inner oil supply holes and an inner oil exhaust hole formed therein;

an outer plunger of which the inner plunger is slidable vertically therewithin, outer oil supply holes communicating with the inner oil supply holes are formed therein, and a hydraulic pressure chamber communicating with an inner side of the inner plunger through the inner oil exhaust hole is formed therein;

a check ball disposed within the hydraulic pressure chamber for selectively closing the inner oil exhaust hole; and a check ball elastic portion biasing the check ball, wherein the adjust housing has adjust housing holes communicating with the outer oil supply holes.

13. The variable valve lift system of claim 9, wherein the connecting portion comprises:

a lock pin slidable laterally within the outer plunger; and an elastic portion biasing the lock pin;

wherein the adjust housing has a lock pin hole formed therein, and the lock pin slides outwards to be inserted into the lock pin hole when hydraulic pressure is supplied to the lock pin from the hydraulic pressure supplying portion.

14. The variable valve lift system of claim 9, wherein the variable valve lift system further comprises a lost motion spring disposed within the adjust housing for biasing the outer plunger.

15. The variable valve lift system of claim 9, wherein the variable valve lift system further comprises a stopper disposed within the adjust housing for limiting movement of the outer plunger.

16. The variable valve lift system of claim 12, wherein the hydraulic pressure supplying portion includes:

adjusting lines adjusting the hydraulic pressure within the inner plunger; and a control line supplying the hydraulic pressure to the connecting portion.

* * * * *